US007997698B2

(12) United States Patent
Davis et al.

(10) Patent No.: US 7,997,698 B2
(45) Date of Patent: Aug. 16, 2011

(54) INK DELIVERY SYSTEM AND METHODS FOR IMPROVED PRINTING

(75) Inventors: Jeremy A Davis, Battle Ground, WA (US); Melissa S. Gedraitis, Camas, WA (US); Marc A. Baldwin, Corvallis, OR (US); Louis Barinaga, Vancouver, WA (US); Daniel D Dowell, Albany, OR (US); Ashley E Childs, Corvallis, OR (US); Mark A. Smith, Corvallis, OR (US); Charles R. Steinmetz, Corvallis, OR (US); Ralph L. Stathem, Lebanon, OR (US); Jeffrey D. Langford, Lebanon, OR (US); Michael L. Hilton, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 432 days.

(21) Appl. No.: 12/261,709

(22) Filed: Oct. 30, 2008

(65) Prior Publication Data

US 2009/0051742 A1 Feb. 26, 2009

Related U.S. Application Data

(62) Division of application No. 11/040,941, filed on Jan. 21, 2005, now Pat. No. 7,510,274.

(51) Int. Cl.
*B41J 2/175* (2006.01)

(52) U.S. Cl. ..... 347/85

(58) Field of Classification Search ..... 347/7, 84, 347/85, 86, 87, 89, 92
See application file for complete search history.

(56) References Cited

U.S. PATENT DOCUMENTS

| | | | |
|---|---|---|---|
| 3,739,717 | A | 6/1973 | Brown et al. |
| 4,184,169 | A | 1/1980 | Taylor et al. |
| 4,303,929 | A | 12/1981 | Blanck |
| 4,329,696 | A | 5/1982 | Denlinger et al. |
| 4,333,088 | A | 6/1982 | Diggins |
| 4,336,037 | A | 6/1982 | Goldis et al. |
| 4,340,895 | A | 7/1982 | Kikuchi |
| 4,359,744 | A | 11/1982 | Salmre |
| 4,364,059 | A | 12/1982 | Nagayama |
| 4,368,478 | A | 1/1983 | Koto |
| 4,376,283 | A | 3/1983 | Bower |
| 4,380,770 | A | 4/1983 | Maruyama |

(Continued)

FOREIGN PATENT DOCUMENTS

EP 1359026 11/2003

(Continued)

OTHER PUBLICATIONS

International Publication No. WO2004/096560 A2 Publication Date Nov. 11, 2004 for International Application No. PCT/US/2004/013164, filing date Apr. 29, 2004.

(Continued)

*Primary Examiner* — Anh T. N. Vo

(57) ABSTRACT

An ink delivery system having at least one off-axis ink supply container and an on-axis printhead assembly. The on-axis printhead assembly includes at least one reservoir and a corresponding standpipe separated by a particle filter. At least one tube connects the off-axis ink supply container to the on-axis printhead assembly. A first valve is configured to selectively open a flow path between the tube and the reservoir. A second valve is configured to selectively open a flow path between the standpipe and the tube.

20 Claims, 6 Drawing Sheets

U.S. PATENT DOCUMENTS

| | | | | |
|---|---|---|---|---|
| 4,399,446 | A | | 8/1983 | McCann et al. |
| 4,403,227 | A | | 9/1983 | Bertschy et al. |
| 4,403,229 | A | | 9/1983 | Barteck |
| 4,413,267 | A | | 11/1983 | Hein |
| 4,476,472 | A | | 10/1984 | Aiba et al. |
| 4,494,124 | A | | 1/1985 | Piatt et al. |
| 4,502,054 | A | | 2/1985 | Brescia et al. |
| 4,502,055 | A | | 2/1985 | Horike et al. |
| 4,527,175 | A | | 7/1985 | Kojima et al. |
| 4,536,776 | A | | 8/1985 | Knirsch et al. |
| 4,599,624 | A | | 7/1986 | Aiba et al. |
| 4,619,842 | A | | 10/1986 | Moss et al. |
| 4,658,268 | A | | 4/1987 | Needham |
| 4,727,378 | A | | 2/1988 | Le et al. |
| 4,811,035 | A | | 3/1989 | Huliba et al. |
| 4,835,554 | A | | 5/1989 | Hoisington et al. |
| 4,837,585 | A | | 6/1989 | Williams et al. |
| 4,862,192 | A | | 8/1989 | Slomianny |
| 4,870,431 | A | | 9/1989 | Sousa et al. |
| 4,929,963 | A | | 5/1990 | Balazar |
| 4,937,598 | A | | 6/1990 | Hine et al. |
| 4,940,995 | A | | 7/1990 | Hine et al. |
| 5,121,130 | A | | 6/1992 | Hempel et al. |
| 5,189,438 | A | | 2/1993 | Hine et al. |
| 5,291,215 | A | | 3/1994 | Nozawa et al. |
| 5,331,339 | A | | 7/1994 | Takahashi |
| 5,341,162 | A | | 8/1994 | Hermanson et al. |
| 5,459,497 | A | | 10/1995 | Manning et al. |
| 5,466,073 | A | | 11/1995 | Rossi et al. |
| 5,532,720 | A | | 7/1996 | Krueger et al. |
| 5,751,300 | A | * | 5/1998 | Cowger et al. ..... 347/6 |
| 5,757,405 | A | | 5/1998 | Bainvel et al. |
| 5,831,655 | A | | 11/1998 | Asawa et al. |
| 5,870,126 | A | | 2/1999 | Kondo et al. |
| 5,936,650 | A | | 8/1999 | Ochida et al. |
| 5,943,078 | A | | 8/1999 | Nishimoto et al. |
| 5,956,062 | A | | 9/1999 | Omata et al. |
| 6,000,792 | A | | 12/1999 | Koizumi |
| 6,033,061 | A | | 3/2000 | Niedermeyer et al. |
| 6,041,709 | A | | 3/2000 | Wells et al. |
| 6,231,174 | B1 | | 5/2001 | Haigo |
| 6,241,344 | B1 | | 6/2001 | Machida |
| 6,331,050 | B1 | | 12/2001 | Nakata et al. |
| 6,428,156 | B1 | | 8/2002 | Waller et al. |
| 6,485,137 | B2 | | 11/2002 | Karlinski et al. |
| 6,491,368 | B1 | | 12/2002 | Cipolla et al. |
| 6,517,189 | B2 | | 2/2003 | Ogawa et al. |
| 6,652,080 | B2 | | 11/2003 | Childs et al. |
| 6,742,882 | B2 | | 6/2004 | Nakamura |
| 6,752,493 | B2 | | 6/2004 | Dowell et al. |
| 6,984,029 | B2 | * | 1/2006 | Bellinger et al. ..... 347/86 |
| 7,040,745 | B2 | * | 5/2006 | Kent ..... 347/89 |
| 7,182,420 | B2 | * | 2/2007 | Nakazawa ..... 347/7 |
| 7,331,664 | B2 | * | 2/2008 | Langford et al. ..... 347/89 |
| 2001/0013882 | A1 | | 8/2001 | Niedermeyer et al. |
| 2002/0063763 | A1 | | 5/2002 | Mantell et al. |
| 2003/0007047 | A1 | | 1/2003 | Otsuka et al. |
| 2003/0202057 | A1 | | 10/2003 | Childs et al. |
| 2003/0202072 | A1 | | 10/2003 | Childs et al. |
| 2003/0202073 | A1 | | 10/2003 | Dowell et al. |
| 2004/0085416 | A1 | | 5/2004 | Kent |
| 2005/0007427 | A1 | | 1/2005 | Bellinger et al. |

FOREIGN PATENT DOCUMENTS

| | | | |
|---|---|---|---|
| EP | 1359027 | | 11/2003 |
| JP | 10329342 | A | 12/1998 |
| JP | 200289222 | A | 10/2000 |
| JP | 2003011380 | A | 1/2003 |
| JP | 2004202799 | A | 7/2004 |

OTHER PUBLICATIONS

English translation of Decision of Rejection for patent application No. 2006-013537 issued by Japan Patent Office. Dispatch date: Aug. 14, 2009.

English translation of Office Action for patent application No. 2006-013537 issued by Japan Patent Office. Dispatch date Nov. 14, 2008.

* cited by examiner

INK DELIVERY SYSTEM AND METHODS FOR IMPROVED PRINTING

This application is a Divisional of, and claims priority to, U.S. patent application Ser. No. 11/040,941, filed on Jan. 21, 2005 now U.S. Pat. No. 7,510,274, which is incorporated herein by reference.

BACKGROUND

Ink delivery systems are utilized by various types of printers to generate text and/or images on a printing medium, such as paper, normally in response to communications and/or control signals from a computer. One known type of ink delivery system includes a printhead assembly that is configured to slide along a shaft in response to communications and/or control signals from a computer. As the printhead assembly slides along the shaft, ink is ejected through nozzles disposed in the printhead assembly onto the print medium to generate the text and/or images. The printhead assembly is said to be positioned "on-axis" because it is coupled to the shaft. While the printhead assembly may have one or more integral ink reservoirs (one per color), the primary bulk supply of ink is located in one or more ink supply containers (one per color) located somewhat remote from the shaft and printhead (though still within the printer), which is referred to as "off-axis" positioning. Typically, the printer includes a plurality of off-axis ink supply containers, each containing a different color or type of ink. The ink supply containers are connected to the printhead assembly by tubes, which provide fluid communication between the ink supply containers and the printhead assembly. Ink is supplied from the ink supply containers through the respective tubes to the printhead assembly at various times.

With such ink delivery systems, there is a desire to reduce or prevent air accumulation in various parts of the printhead assembly, because an over-accumulation of air in the printhead assembly can degrade the printing quality and/or reduce the usable life of the printhead assembly. There is a further desire to reduce or prevent water evaporation through the nozzles, for example, during long duration storage, because such may leave accretions in the nozzle bore made up of the non-volatile ink components. Another desire is to reduce or prevent obstructions, including kinks, in the tubes connecting the off-axis ink supply containers to the printhead assembly.

The embodiments described hereinafter were developed in light of these and other desires.

DETAILED DESCRIPTION

Figure 1:
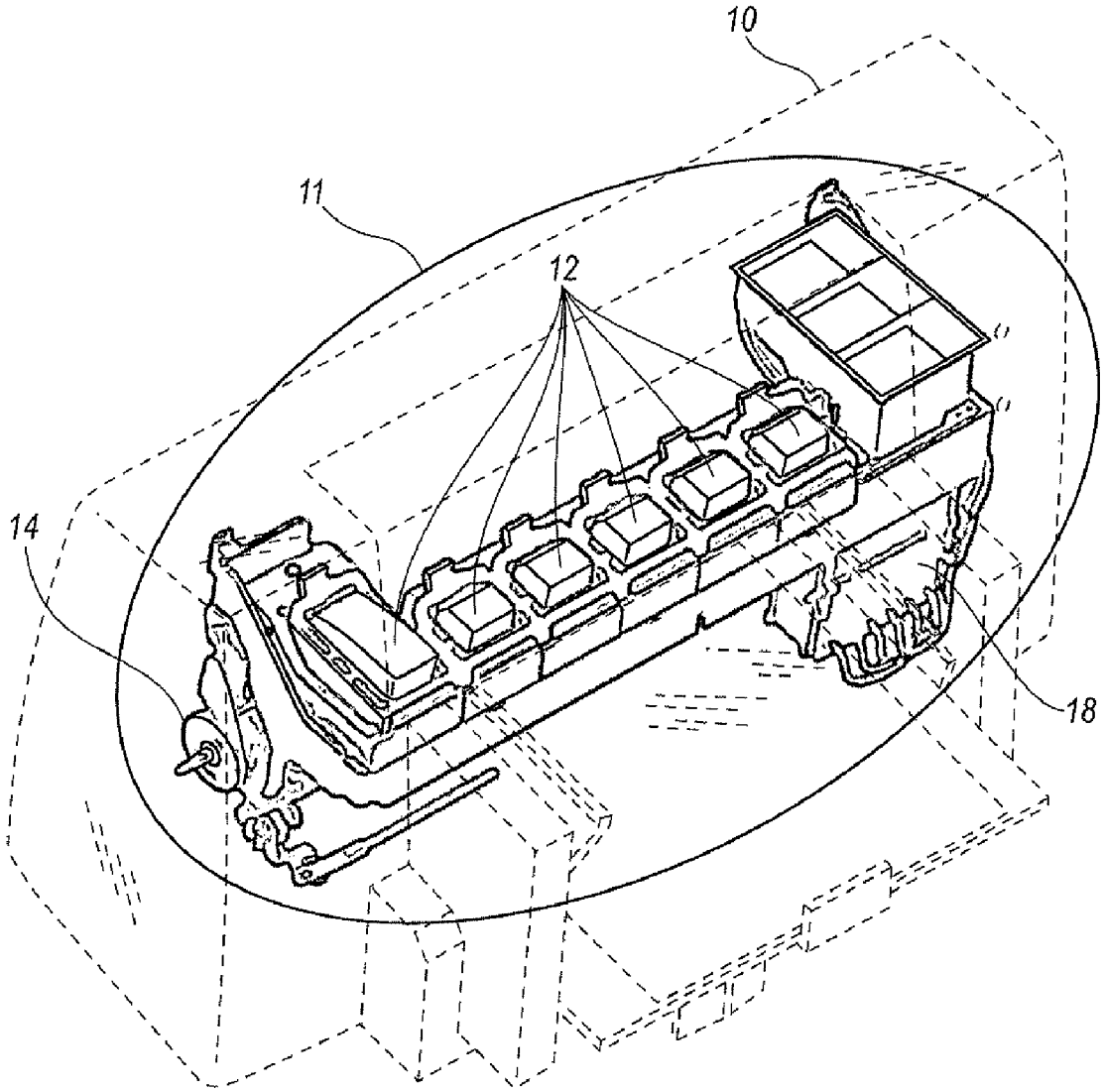
FIG. 1 illustrates an ink delivery system in a printing device, according to an embodiment.

Systems and methods for improved ink delivery in an ink jet delivery system are disclosed. One exemplary system includes an on-axis printhead assembly having one or more ink reservoirs and a plurality of corresponding nozzles used to eject ink from the respective reservoirs onto a print medium, such as paper. The printhead includes a reservoir for each color printable by the printer. Each reservoir is fluidicly connected to a group of corresponding nozzles through a fluid channel. A particle filter is disposed between each reservoir and the nozzles to filter unwanted particles as the ink flows from the reservoir to the nozzles. The system further includes one or more off-axis ink supply containers for storing quantities of ink. Each reservoir in the printhead assembly is typically fed by a corresponding off-axis ink supply container. The system includes a first flow path between each off-axis supply container and the corresponding reservoir of the printhead assembly (upstream of the filter). Further, the system includes a second flow path between each off-axis supply container and the fluid channel downstream of the filter. The first flow path facilitates the delivery of ink from the off-axis supply container to the corresponding reservoir and to evacuate air from the printhead assembly upstream of the filter. The second flow path is used to evacuate air from the printhead assembly downstream of the filter. Portions of the first and second flow paths may be shared. A bi-directional pump or the like is used to evacuate air through the first and second flow paths. Further, the pump and air/ink sensor are used with the second flow path and the first flow path to determine if accretions have formed in the tubes and to remove such accretions from the ink delivery system. Finally, the pump is used with the second flow path to aid in the removal of accretions Referring now to FIG. 1, a printing device 10 is shown according to an embodiment. Printing device 10 is used to generate text and/or images on a printing medium, such as paper. Printing device 10 includes an ink delivery system 11. The ink delivery system includes a printhead assembly 18 and, in this embodiment, a plurality of off-axis ink supply containers 12 (*a-f*) (collectively referred to as element 12) that each store a supply of a different color of ink. The ink supply containers 12 are fluidicly connected to corresponding reservoirs (not shown in FIG. 1) in the printhead assembly 18 via one or more flow paths (not shown in FIG. 1), which may consist of plastic tubes. Bi-directional pump 14 causes ink to be pumped through the flow paths, both toward the printhead assembly 18, and away from the printhead assembly 18, depending on the activation direction of the pump. Various types of bi-directional pumps may be used, including peristaltic pumps. In some embodiments, bi-directional pump 14 includes an "idle" state. The pump is controlled by a controller and/or electronic control circuit (not shown).

Figure 2:
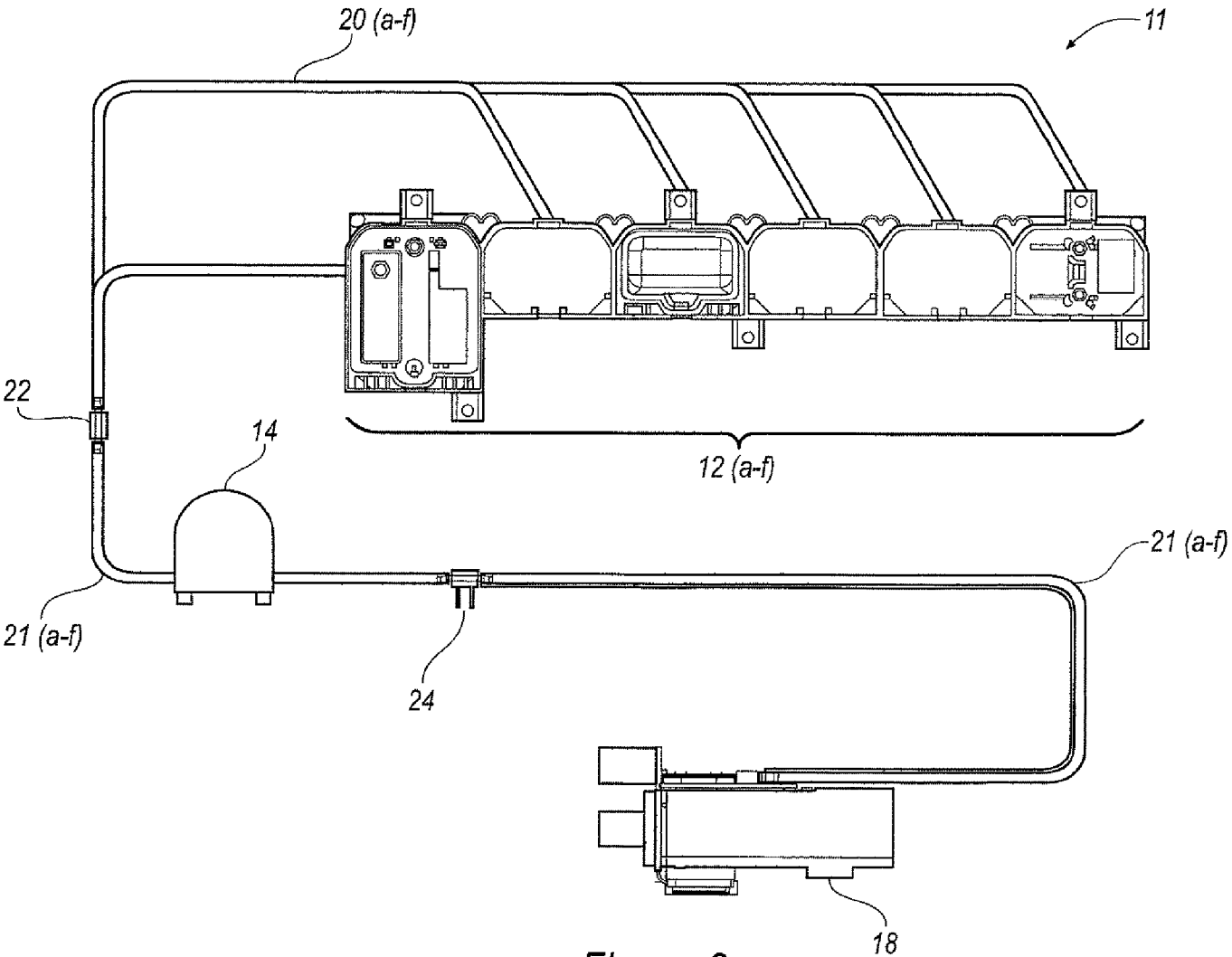
FIG. 2 illustrates a more detailed view of the ink delivery system of FIG. 1, according to an embodiment.

FIG. 2 illustrates the exemplary ink delivery system 11 in more detail. Off-axis ink supply containers 12(*a-f*) are each connected to corresponding reservoirs (not shown in FIG. 2) in the printhead assembly 18 through tubes 20(*a-f*) and 21(*a-f*). Tubes 20(*a-f*) and 21(*a-f*) are connected by coupling 22. In some embodiments, tubes 20(*a-f*) are static or rigid, and tubes 21(*a-f*) are dynamic or flexible to accommodate the moving printhead assembly 18. Further, in some embodiments, tubes 20(*a-f*) and 21(*a-f*) can both be dynamic or both be static. Further, in some embodiments—particularly where tubes 20(*a-f*) and 21(*a-f*) are both made from the same material—tubes 20(*a-f*) and 21(*a-f*) may be integral, thereby eliminating the need for coupling 22. In other embodiments, each off-axis ink supply container 12 may correspond to and be fluidicly connected to the printhead assembly 18 by a plurality of tubes 12, instead of just one as shown in FIG. 2. Bi-directional pump 14 and air/ink sensor 24 are both interposed in the flow path between ink supply containers 12(*a-f*) and printhead assembly 18 (shown as interposed in tube 21(*a-f*) in FIG. 2). The bi-directional pump 14 is configured to selectively move ink and/or air in either direction in the flow path between the ink supply containers 12(*a-f*) and the printhead assembly 18. The air/ink sensor 24 is configured to sense and distinguish between air and/or ink passing therethrough.

Figure 3:
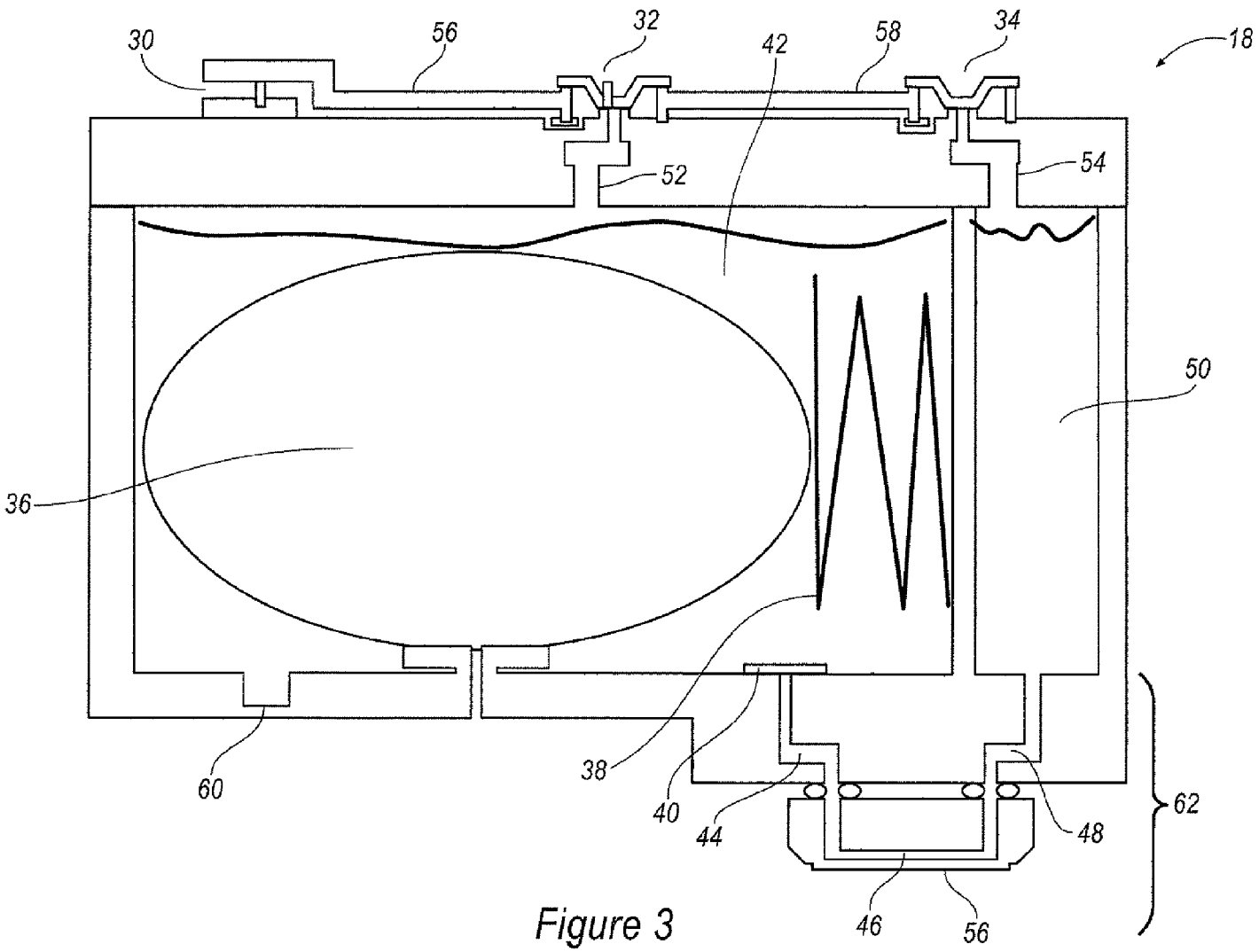
FIG. 3 illustrates a close-up cross-sectional view of a printhead assembly included in the ink delivery system of FIGS. 1 and 2, according to an embodiment.

FIG. 3 illustrates a close-up cross-sectional view of an exemplary printhead assembly 18. FIG. 3 shows only the components corresponding to a single reservoir for a single color. It is understood that printhead assembly 18 includes a reservoir (and associated components shown and described in FIG. 3) for each color printable by the printing system. One of the tubes 21(*a-f*) (in FIG. 2) is connected to printhead inlet 30 to provide fluid communication between the off-axis ink supply container 12 and the printhead assembly 18. Inlet 30 is fluidicly connected to three-way inlet valve 32. One port of inlet valve 32 is connected to fluid channel 56; one port of inlet valve 32 is connected to fluid channel 58; and the third port of inlet valve 32 is connected to fluid channel 52. When valve 32 is open to fluid channel 52, ink is permitted to flow into reservoir 42. Each reservoir 42 includes an accumulator bag 36 and spring 38 along with a bubbler 60 to maintain a slight negative pressure in the reservoir 42, as is known in the art. A particle filter 40 separates the reservoir 42 from the lower body portion 62 of the print head assembly 18. As needed, ink may flow through particle filter 40 into inlet channel 44 and ultimately into plenum 46, which resides directly above a slot (not shown). The slot ultimately feeds a thermal printing device (not shown), which ejects ink through nozzles (not shown) disposed in the bottom side 56 of the lower body portion 62 of the printhead assembly 18, according to methods known in the art. The plenum 46 is also fluidicly-connected to a two-way recirculation valve 34 via a flow path, which is shown in FIG. 3 as comprising a fluid channel 48, a standpipe 50 and a fluid channel 54. Recirculation channel 48, snorkel 50 and fluid channel 54 may all be generically and collectively referred to herein as fluid flow paths. Recirculation valve 34 is fluidicly-connected to inlet valve 32 via fluid channel 58.

Referring generally to FIGS. 1-3, the relevant operation of the print system will now be described. A bulk supply of each ink is stored in its own ink supply container 12(*a-f*). A relatively small amount (typically, about 2-3 cc) of each ink is stored in the corresponding reservoirs 42 on the printhead assembly 18. To generate text and/or images on a print medium, the printhead assembly causes ink droplets to be ejected from the nozzles (not shown) on the bottom surface 56 of the printhead assembly 18 according to methods known in the art. As ink droplets are ejected from the nozzles, ink is drawn from reservoir 42 into inlet channel 44 and plenum 46 to replace the ejected ink. As ink is drawn from reservoir 42, it passes through particle filter 40 to remove undesirable particles in the ink. The particle filter 40 is so fine that it prevents air from passing there-through.

Figure 4:
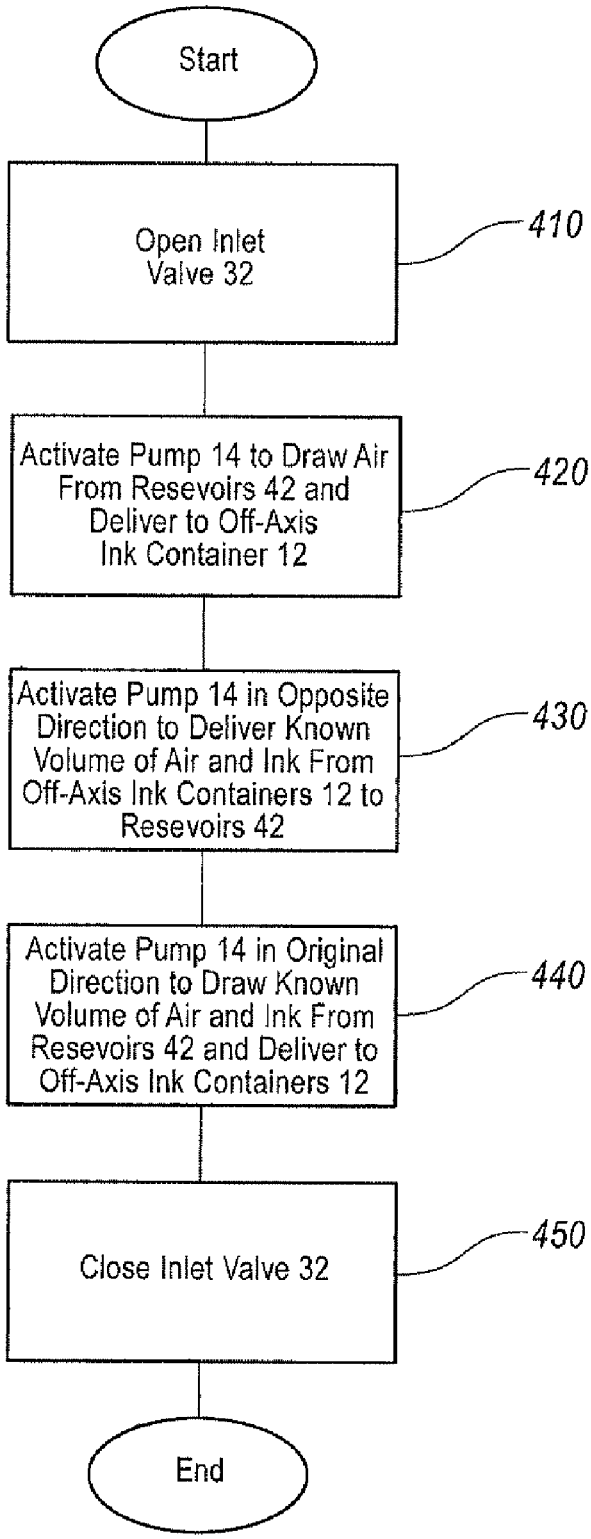
FIG. 4 is a flow chart, illustrating exemplary steps of a "recharge" algorithm, according to an embodiment.

At various times, the reservoirs 42 are "recharged" with ink by drawing ink from the off-axis ink containers 12 into the corresponding reservoirs 42. The reservoirs 42 can be "recharged" based on various "triggering events", such as between print jobs or when the ink level in the reservoir dips to a certain pre-defined level. Referring to FIG. 4, the steps for one exemplary "recharge" algorithm are described in more detail. At step 410, the inlet valve 32 is opened to provide a flow path into reservoir 42. The inlet valve 32 can be opened using various techniques, such as, for example, causing the printhead assembly 18 to move to a predefined location along the shaft so as to mechanically open the inlet valve 32. At step 420, pump 14 is activated so as to draw air and ink from reservoir 42 through inlet valve 32 and to deliver the air and ink to the off-axis ink container 12, where it is pumped through the ink container and vented to atmosphere through vent chambers (not shown). The pump 14 draws a pre-determined volume of fluid from each reservoir 42, which is monitored based on the degrees of rotation of pump 14. Normally, the ink levels in each of the reservoirs 42 will be different as a result of using different amounts of the various colors. The pre-determined fluid volume is typically chosen so as to ensure that all free air has been removed from all of the reservoirs 42, regardless of the different ink level in the different reservoirs. As the air is pumped from the reservoirs 42, the accumulator bag 36 inflates to replace the volume of air removed. When the accumulator bag 36 becomes fully inflated, the bubble generator 60 begins to operate. Because of the differences in the ink/air volume in each reservoir 42 at the beginning of the "recharge" cycle, each accumulator bag 36 will become fully inflated at a different time. The bubble generators 60 act as a kind of pressure relief valve so that the accumulator bags 36 that become fully inflated first, but do not become over inflated. Furthermore, the pressure at which the bubble generators bubble air is significantly lower than the bubble pressure of the nozzles such that, during a "purge" cycle, the nozzles don't ingest air into the standpipe region of the printhead.

After all of the accumulator bags 36 are fully inflated, the direction of the pump 14 is reversed at step 430 so as to pump a known volume of air and ink from the off-axis ink containers 12 to the reservoirs 42. The actual volume of air/ink pumped into reservoir 42 may be monitored based upon the volume per pump cycle and the number of pump cycles of pump 14, as above. The air/ink sensor 24 is used to determine what proportion of the known air/ink volume pumped into the reservoirs 42 is ink and what proportion is air. The known volume of air/ink is predetermined so that any reservoirs 42 that were completely depleted of ink before the "recharge" method was employed are now full of ink and that reservoirs 42 that were not completely depleted before the "recharge" method was employed are "overfull" (the reservoirs 42 and accumulator bags 36 are sized to accommodate the "overfull" situation without spilling ink).

At step 440, the direction of pump 14 is again reversed to its original direction. Pump 14 now draws a known volume of air and ink from reservoirs 42. The ink is returned to the off-axis ink container 12 and the air is vented through the off-axis ink container vent chamber (not shown). After step 440, all air has been removed from the reservoirs 42. Further, an appropriate amount of fluid back pressure has been set in the printhead 18 to ensure optimal printing. Further the ink level in each reservoir has been set. At this point, inlet valve 32 is closed at step 450. Thereafter, the printing device is ready to print again.

While the above-described "recharge" algorithm effectively recharges the reservoir 42, removes air from the reservoir 42, and resets the fluid back pressure in the printhead assembly 18, it is not effective at removing accumulated air from the lower body 62 of printhead assembly 18 downstream of filter 40, including channels 44, 46, and 48, snorkel 50 and channel 54. As previously indicated, filter 40 is commonly sufficiently fine as to prevent air from passing through. Thus, air that has accumulated downstream of particle filter 40 (in the lower body 62) cannot be evacuated through reservoir 42. Therefore, a "purge" algorithm can be performed in the print system periodically to remove air that has accumulated in the lower body 62 downstream of the filter 40. The purge algorithm can be initiated based upon a variety of different triggering events, such as after a certain amount of ink has been ejected from the printhead nozzles, directly after a "recharge" cycle, after a certain elapsed time, or by the manual initiation of the user (e.g., pushing a button on the print system), for example.

Figure 5:
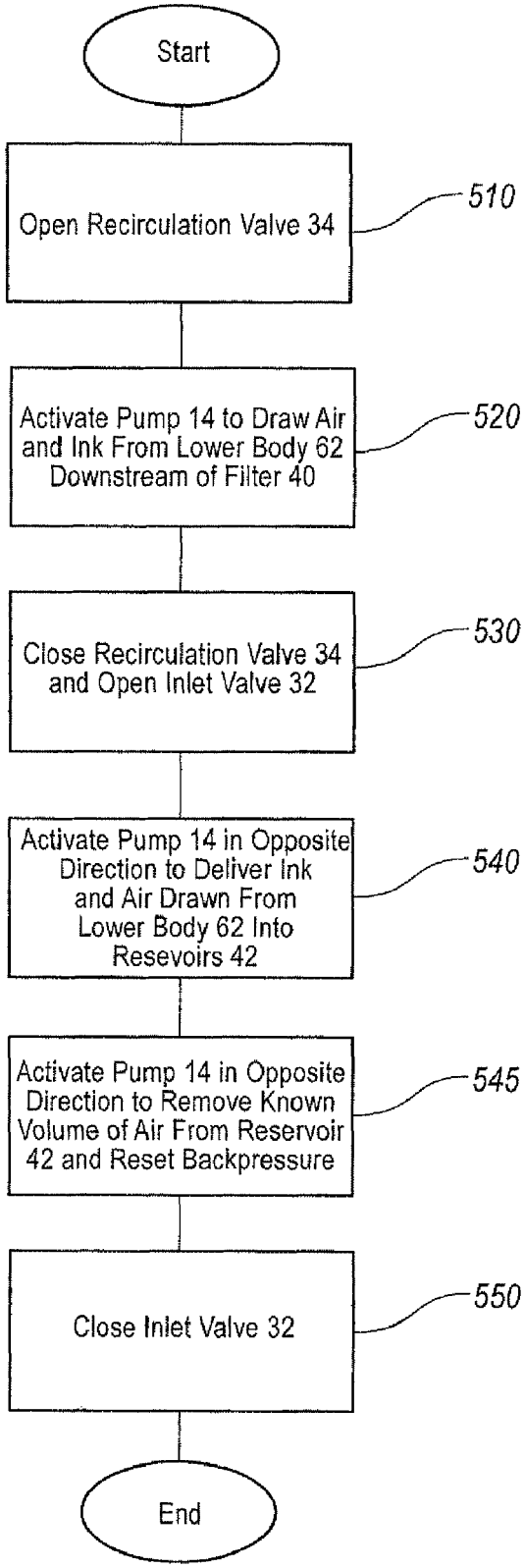
FIG. 5 is a flow chart, illustrating exemplary steps of a "purge" algorithm, according to an embodiment.

The "purge" algorithm may also be used to aid in the recovery of plugged nozzles that result from long duration storage. By moving fresh ink into the lower body 62, including fluid flow paths 44, 46, 48, 50 and 54, the viscous fluid made up of non-volatile solvents that is present in the firing chamber is diluted with ink vehicle containing a sufficient concentration of water so as to enable the formation of a drive bubble that is capable of firing a drop which carries with it the accretion. As a result, any accretions that may have formed in the nozzles of the printhead assembly 18 will be removed With reference to FIG. 5, steps of an exemplary "purge" algorithm are described. At step 510, recirculation valve 34 is opened. As above, a variety of techniques may be used for opening the recirculation valve 34, including, for example, moving the printhead assembly to a predefined location on the shaft so as to mechanically open the recirculation valve 34. At step 520, pump 14 is activated so as to draw air and ink from the lower body 62 of printhead assembly 18 (downstream of filter 40). The pump draws a known volume of air and ink from the lower body 62, including fluid flow paths 44, 46, 48, 50 and 54, back into tube 21. The known volume is predetermined so as to remove all air and ink from the portion of the printhead assembly downstream of the filter 40.

At step 530, the recirculation valve 34 is closed and the inlet valve 32 is opened. At step 540, the pump 14 is activated in the opposite direction so as to pump the air and ink just removed from the lower body 62 back into reservoir 42. In this way, ink removed from the lower body 62 downstream of filter 40 is not wasted.

At step 545, the pump is again reversed and a known volume of air is then removed from reservoir 42 so as to reset the backpressure in reservoir 42.

At step 550, inlet valve 32 is closed. At this point, all air has been removed from the lower body 62, downstream of filter 40.

The above-described "recharge" algorithm includes steps for removing accumulated air from the reservoir 42 of the printhead assembly 18, and the above-described "purge" algorithm removes air from the lower body 62 of printhead assembly 18 downstream of filter 40. Together, the "recharge" and "purge" algorithms remove accumulated air from the printhead assembly 18, both upstream and downstream of the filter 40, without ejecting ink from the nozzles. Thus, there is little or no ink wasted when removing the air, and, accordingly, there is no little or no need for waste components to dispose of expelled ink. Moreover, the "purge" routine effectively removes accretions from the nozzles of the printhead assembly 18. Further, the "recharge" routine, in addition to removing accumulated air from the reservoir 42, delivers ink from the off axis ink supply, resets the backpressure in the printhead assembly, and sets the ink level in the printhead reservoirs to ensure optimal printing capability.

Figure 6:
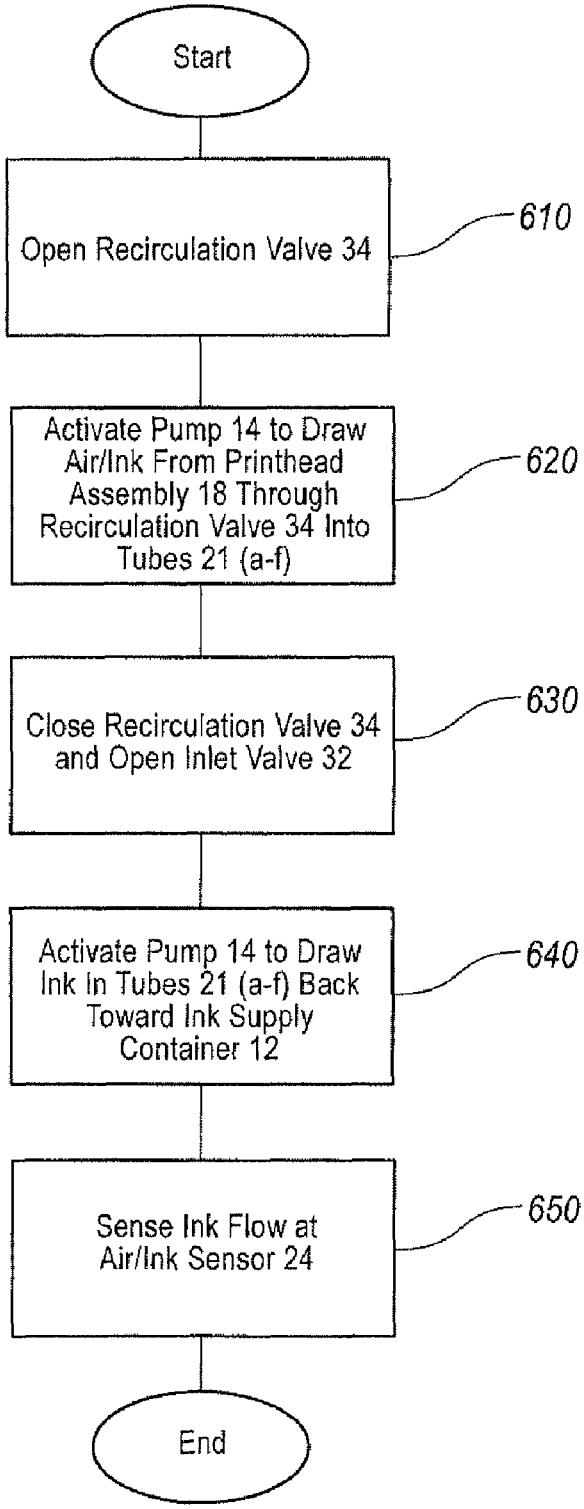
FIG. 6 is a flow chart, illustrating exemplary steps of an "obstruction detection" algorithm, according to an embodiment.

FIG. 6 illustrates an "obstruction detection" algorithm that can be selectively implemented in the above-described printing device. The "obstruction detection" is configured to determine if an obstruction to the ink flow exists somewhere in the tubes 20 and 21. Obstructions can occur in the tubes 20 and 21 as a result of a kink, for example. Such obstructions may ultimately cause leaks in the printing device as a result of trying to pump ink past the obstructions. With reference to FIG. 6, the "obstruction detection" algorithm begins by opening the recirculation valve 34, as shown at step 610. Then, pump 14 is activated to draw a predetermined amount of ink from the printhead assembly 18 through recirculation valve 34 into tube 21, as shown in step 620. As described hereinafter, the drawn ink—referred to herein as an "ink slug"—is used to determine if there is an obstruction in the ink flow path. Accordingly, the determined amount of ink is normally relatively small. Thereafter, the recirculation valve 34 is closed and inlet valve 32 is opened, as shown at step 630. Pump 14 is activated to draw the ink now in tube 21 back toward ink supply container 12, as shown at step 640. As the ink slug passes through tube 21, it necessarily passes through air/ink sensor 24. The air/ink sensor 24 determines when the ink slug passes, as shown in step 650. Using the output of the air/ink sensor 24, a controller or other control circuitry (not shown) determines the elapsed time required for the ink slug to pass by the air/ink sensor 24. If there are no obstructions in the ink flow path (i.e., in the printhead assembly and in the tubes 20 and 21), the ink slug will pass by the air/ink sensor 24 after a known elapsed time. If an obstruction exists somewhere in the ink flow path, then the ink slug will either not pass by the air/ink sensor at all or it will pass by after an elapsed time different than that which is expected or not at all. That is, the ink slug will move through the tubes more slowly than expected. If an obstruction is detected, a variety of actions can be taken, including activating an error message on the printer and/or activating a "purge" routine to attempt to remove an accretion that may have formed in the nozzles, for example.

While the present invention has been particularly shown and described with reference to the foregoing preferred embodiment, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiment is illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

The invention claimed is:

1. An ink delivery system, comprising:

at least one off-axis ink supply container;

an on-axis printhead assembly having at least one reservoir and a corresponding standpipe separated by a particle filter, the particle filter to both allow ink to flow and to prevent air from passing through the particle filter;

at least one tube connecting said off-axis ink supply container to said printhead assembly;

a first valve configured to selectively open a flow path between said tube and said reservoir, the first valve being a three-way valve having a first port connected to the tube and a third port connected to permit ink to flow into the reservoir; and a second valve configured to selectively open a flow path between said standpipe and said tube through a second port of the first valve.

2. The system of claim 1, further comprising a sensor interposed in said tube, said sensor configured to sense the presence of ink.

3. The system of claim 1, further comprising a bi-directional pump interposed in said tube, said pump being configured to selectively draw fluid from said printhead assembly and deliver fluid to said printhead assembly.

4. The system of claim 3, wherein said bi-directional pump further includes an idle state.

5. The system of claim 3, wherein said bi-directional pump is a peristaltic pump.

6. The system of claim 1, wherein said printhead assembly includes a plurality of reservoirs, each reservoir being fluidicly-connected to a separate off-axis ink supply container by at least one corresponding tube.

7. The system of claim 1, wherein said tube comprises a first portion that is static and a second portion that is dynamic, said first and second portions being coupled together.

8. The system of claim 1, wherein said printhead assembly further comprises a lower body portion positioned between said particle filter and said standpipe, said lower body portion having a plurality of nozzles configured to eject ink droplets in response to control signals.

9. The system of claim 1, further comprising an accumulator bag disposed in said reservoir.

10. The system of claim 1, wherein said reservoir is fluidicly-connected to said off-axis ink supply container by a first tube and said standpipe is fluidicly-connected to said off-axis ink supply container by a second tube.

11. An ink delivery system, comprising:

an on-axis printhead assembly having at least one reservoir and a corresponding standpipe separated by a particle filter, the particle filter to allow ink to flow and to prevent air from passing through the particle filter;

a fluid conduit configured to couple the printhead assembly to an off-axis ink supply container;

a three-way valve configured to selectively open a flow path between the fluid conduit and the reservoir, the flow path between the fluid conduit and the reservoir fluidicly connecting through a first port and a third port of the three-way valve; and a two-way valve configured to selectively open a flow path between the standpipe and the fluid conduit, the flow path between the standpipe and the fluid conduit fluidicly connecting through the first port and a second port of the three-way valve.

12. The system of claim 11, further comprising a sensor interposed in the fluid conduit, the sensor configured to sense the presence of ink.

13. The system of claim 11, further comprising a bi-directional pump interposed in the fluid conduit, the pump being configured to selectively draw fluid from the printhead assembly and deliver fluid to the printhead assembly.

14. The system of claim 13, wherein the bi-directional pump further includes an idle state.

15. The system of claim 13, wherein the bi-directional pump is a peristaltic pump.

16. The system of claim 11, wherein the printhead assembly includes a plurality of reservoirs, each reservoir configured to be fluidicly coupled to a respective off-axis ink supply container by at least one corresponding fluid conduit.

17. The system of claim 11, wherein the fluid conduit comprises a first portion that is static and a second portion that is dynamic, the first and second portions being coupled together.

18. The system of claim 11, wherein the printhead assembly further comprises a lower body portion positioned between the particle filter and the standpipe, the lower body portion having a plurality of nozzles configured to eject ink droplets in response to control signals.

19. The system of claim 11, further comprising an accumulator bag disposed in the reservoir.

20. The system of claim 11, wherein the reservoir is fluidicly coupled to an off-axis ink supply container by a first fluid conduit and the standpipe is fluidicly coupled to the off-axis ink supply container by a second fluid conduit.

* * * * *